United States Patent [19]

Willemse et al.

[11] Patent Number: 4,553,878

[45] Date of Patent: Nov. 19, 1985

[54] OFFSHORE TOWER CONSTRUCTIONS AND METHODS OF ERECTION AND INSTALLATION THEREOF

[75] Inventors: Kees Willemse, Leiden; Jan Meek, Gouda, both of Netherlands; Finn C. Michelsen, Kailua, Hi.

[73] Assignee: Heerema Engineering Service, Netherlands

[21] Appl. No.: 471,490

[22] Filed: Mar. 2, 1983

[30] Foreign Application Priority Data

Mar. 5, 1982 [GB] United Kingdom ..... 8206509

[51] Int. Cl.[4] ..... E02D 21/00; E02D 23/02; E02D 25/00

[52] U.S. Cl. ..... 405/203; 405/204

[58] Field of Search ..... 405/195, 200, 203–205, 405/207, 208, 224, 202, 227; 114/264, 265

[56] References Cited

U.S. PATENT DOCUMENTS

| | | | |
|---|---|---|---|
| Re. 30,823 | 12/1981 | Guy et al. | 405/204 |
| 2,653,451 | 9/1953 | McCullough | 405/195 |
| 3,372,745 | 3/1968 | Holmes | 405/200 X |
| 3,390,531 | 7/1968 | Johnston | 405/227 |
| 3,524,322 | 8/1970 | Pogonowski | 405/227 |
| 3,546,885 | 12/1970 | Pogonowski | 405/227 |
| 3,556,210 | 1/1971 | Johnson | 405/203 X |
| 3,641,774 | 2/1972 | Hekkanen et al. | 405/204 |
| 3,716,994 | 2/1973 | Pogonowski | 405/204 |
| 3,876,181 | 4/1975 | Lucas | 405/205 X |
| 4,000,624 | 1/1977 | Chow | 405/204 |
| 4,018,057 | 4/1977 | Erzen et al. | 405/205 X |
| 4,063,426 | 12/1977 | Hansen | 405/205 |
| 4,170,431 | 10/1979 | Wood | 405/202 |

FOREIGN PATENT DOCUMENTS

| | | | |
|---|---|---|---|
| 2270390 | 12/1975 | France | 405/207 |

*Primary Examiner*—Cornelius J. Husar
*Assistant Examiner*—Nancy J. Stodola
*Attorney, Agent, or Firm*—Fulwider, Patton, Rieber, Lee & Utecht

[57] ABSTRACT

An offshore tower structure comprising a base structure for positioning on and fixing to the sea bed, a central column for containing services such as conductors and risers and extending, in use, from the base structure to above the water level for supporting a platform, at least three support legs each extending between an upper portion of the column and the base structure at points spaced from the column for providing support for the column, and a bracing structure comprising a framework lying intermediate the ends of the column in a plane perpendicular to the longitudinal axis of the column, the framework connecting each pair of adjacent legs and each leg directly or indirectly with the column, and bracing elements between the column and the legs or between adjacent legs extending from the plane of the framework to respective points at or adjacent the base of the structure.

4 Claims, 9 Drawing Figures

FIG. 6. b.

OFFSHORE TOWER CONSTRUCTIONS AND METHODS OF ERECTION AND INSTALLATION THEREOF

The invention relates to offshore tower structures, and to the erection and installation of such structures. More particularly, but not exclusively, the invention relates to structures which can be used in deep water operations.

BRIEF SUMMARY OF THE INVENTION

According to one aspect of the invention there is provided an offshore tower structure comprising a base structure for positioning on and fixing to the sea bed, a central column for containing services such as conductors and risers and extending, in use, from the base structure to above the water level for supporting a platform, at least three support legs each extending between an upper portion of the column and the base structure at points spaced from the column and the base structure at points spaced from the column for providing support for the column, and a bracing structure comprising a framework lying intermediate the ends of the column in a plane perpendicular to the Where there are three support legs, the first framework is preferably in the form of a triangle into the points of attachment of the legs to the framework being at the apices of the triangle. The said bracing elements preferably extend diagonally from the apices of the triangle. The bracing unit may comprise free ends for securement to the legs and column by welding or a set of sleeves for respective engagement by the legs and column. Where the bracing unit comprises a set of sleeves, each leg and the column are preferably secured to an associated sleeve by grouting or an equivalent fixing method. Alternatively, the bracing structure may be provided by separate elements incorporated during construction of the tower structure. In such a case, the planar framework may be prefabricated and the diagonal bracing elements included as separate elements, or alternatively each leg may be prefabricated with a diagonal bracing element and an element constituting, in the completed tower structure, the connection of the framework between the leg and the column, the framework connections between adjacent legs being included as separate elements.

The invention further provides a method of constructing a column and leg assembly for an offshore tower structure of the type comprising a base structure for positioning on and fixing to the sea bed a central column for containing services and extending in use from the base structure to above the water level for supporting a platform, support legs extending between an upper portion of the column and the base structure and a bracing structure for bracing the column and leg assembly, which method comprises the steps of floating the column on the surface of water, attaching the bracing structure on the column while floating, and attaching the legs to he assembled column and bracing structure.

The bracing structure is preferably prefabricated, the bracing unit is preferably attached to the column while floating in inshore waters, for example a deep water fjord.

Attachment of the legs to the column and bracing unit is preferably carried out by floating a first leg into a desired position in relation to the floating column and the bracing unit, securing the first leg to the column and the bracing unit, rotating the column, leg and bracing unit about the longitudinal axis of the column, floating into position and securing to the column and bracing unit a second leg, and repeating the rotating and leg securing steps until all the legs are secured to the column and bracing unit.

The column, bracing unit and legs may be secured together by welding. Alternatively, the bracing unit may comprise a set of sleeves for engagement by the column and legs, in which case the bracing unit is preferably secured to the legs and column by grouting, with the legs preferably being secured to the column by welding.

When the column and leg assembly is completed, the assembly is preferably towed to a final site, located on a preinstalled foundation, a platform is secured on the column and the column and legs secured to foundations on the sea bed. Alternatively, the foundations may be secured to the column and leg assembly inshore, and the completed assembly floated out and installed offshore in the final location.

By way of example, embodiments of an offshore tower structure according to the invention and methods of constructing offshore tower structures according to the invention will now be described with reference to the accompanying drawings, in which:

FIG. 1 is a side view of one embodiment of a complete offshore tower structure;

FIG. 2*a* and 2*b* show views from side and in plan respectively of a preformed unit for the tower structure of FIG. 1;

FIG. 3 shows the bracing unit of FIGS. 2*a* and 2*b* being secured to a central column; while the column is floating FIG. 4 is a plan view of the floating column and bracing unit of FIG. 3 with a leg being secured while the leg is floating FIG. 5 is a side view of a floating column, leg and bracing unit assembly;

FIGS. 6*a* and 6*b* show a side view and plan view respectively of a modified preformed bracing unit; and FIG. 7 shows a column and leg assembly including the bracing unit of FIGS. 6*a* and 6*b* about to be lowered onto a foundation.

DESCRIPTION OF THE PREFERRED EMBODIMENT

Figure 1:
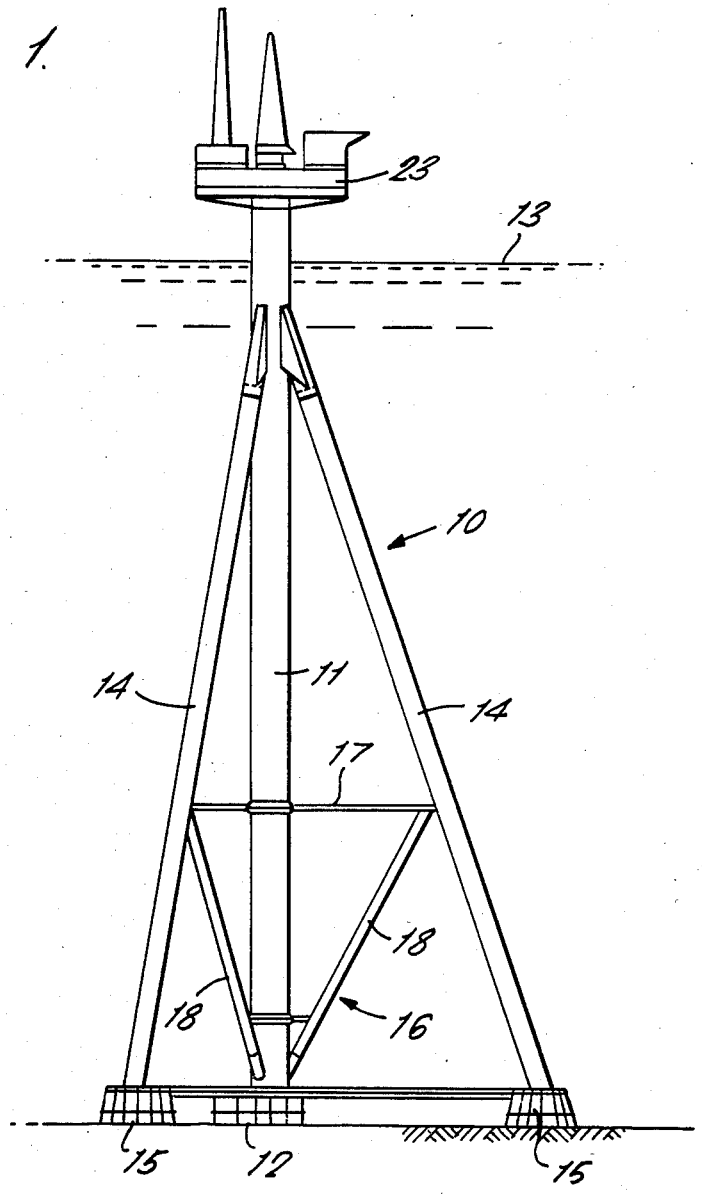
Figure 2A:
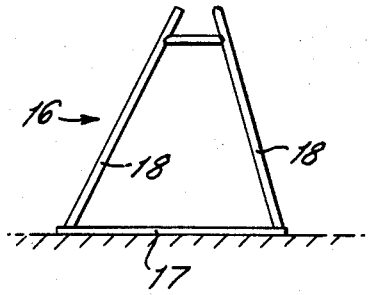
Figure 2B:
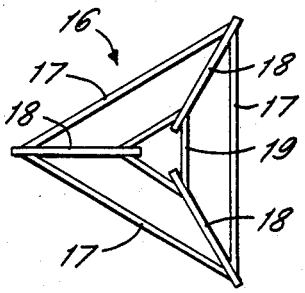

FIG. 1 is a side view of a complete offshore tower structure, generally indicated at 10. The tower structure has a central column 11 for containing services such as conductors and risers, the column 11 being supported on a column foundation 12. Secured to the column near water level 13 are three legs 14 forming a tripod structure, each leg 14 being supported by a leg foundation 15. The structure further includes a preformed bracing unit 16 having horizontal bracing elements 17 extending between adjacent legs 14 and between the legs 14 and the column 11, and elements 18 extending diagonally betwen the column 11 and the horizontal elements 17. The column 11 supports a platform 28.

Details of the tower structure of FIG. 1, the method of construction and the method of installation thereof will now be described in more detail with reference to FIGS. 2 to 5.

The first stage in construction is for the bracing unit 16 to be built in a construction basin. When completed, the bracing unit 16 is towed to an inshore assembly site, for example a deep water fjord. The bracing unit 16 is of tubular steel members welded together. There are three outer horizontal bracing elements 17 which together form a triangle as seen in FIG. 26 and which in the assembled tower structure extend between adjacent legs 14. There is in addition, a further horizontal bracing element at each of the three apices of the triangle, each of which in the assembled tower structure extends from a leg to the column 11 (these three further elements are hiddenin FIG. 26 by elemens 18). Elements 18 extend diagonally to the column from the horizntal elements 17, at each apex of the triangle, as seen from FIGS. 2*a* and 2*b* the elements 18 being held rigid by a triangular frame 19.

It will be appreciated that alternative configurations are possible for the bracing unit. For example, the three further horizontal bracing at the apices of the triangle which extend one from each leg to the column could be substituted by three, or in some cases two horizontal bracing elements each extending instead from the column to the mid point of an associated outer bracing element 17.

Figure 3:
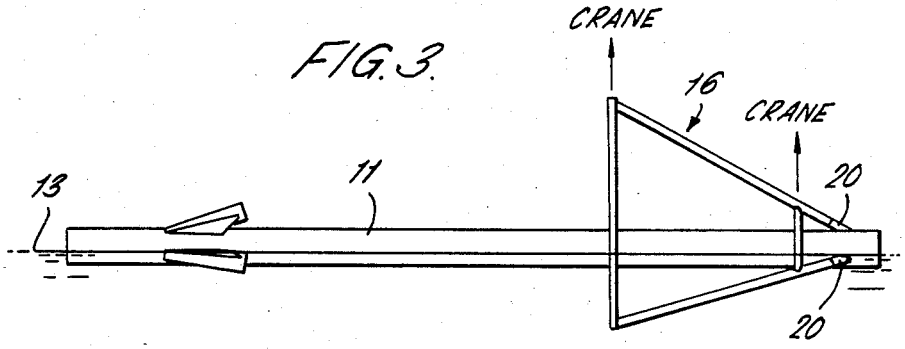
Figure 4:
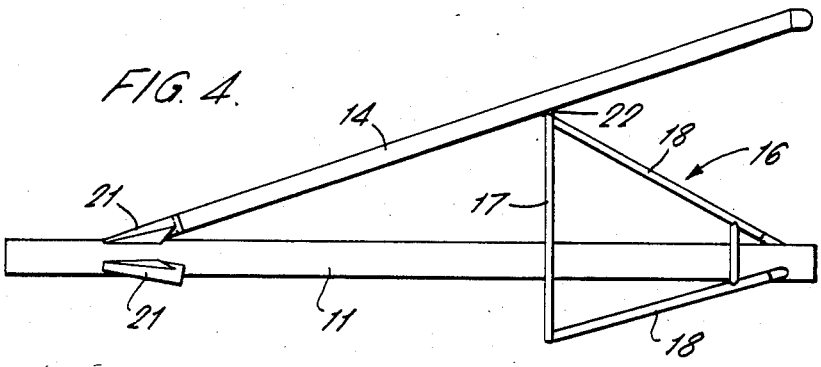

When constructed, the bracing unit 16 is floated and towed to an inshore assembly site where it is welded to the central column 11. The column 11 is provided with six spuds 20, three of which are for engagement with the free ends of the elements 18 (as seen in FIG. 3) the other three of which are for engagement with the further horizontal bracing elements (which are hidden in FIG. 3). The column 11 is floated into a position such that the spuds 20 engage the elements of the bracing unit 16. The bracing unit is then welded to the column 11 and the spuds 20 (FIG. 3) at water level.

The next stage in assembly is for the legs to be towed to the assembly site. A first leg 14 is floated into one of three sleeves 21 provided on the central column 11, as seen in plan in FIG. 4, the leg 14 also resting against the bracing unit 16. The leg is provided with a spud 22 where it rests against the bracing unit 16. The leg 14 is then welded to the column 11 and to the bracing unit 16, both welds being carried out at water level.

When this part of the assembly is completed, the structure is rotated about the axis of the column 11 and held in a stable position, for example by a barge. A second leg 14 is floated into position and attached in the same way as the first leg at water level. The sequence is repeated for the third leg and at this stage, a column and leg assembly as shown in FIG. 5 has been constructed.

Figure 5:
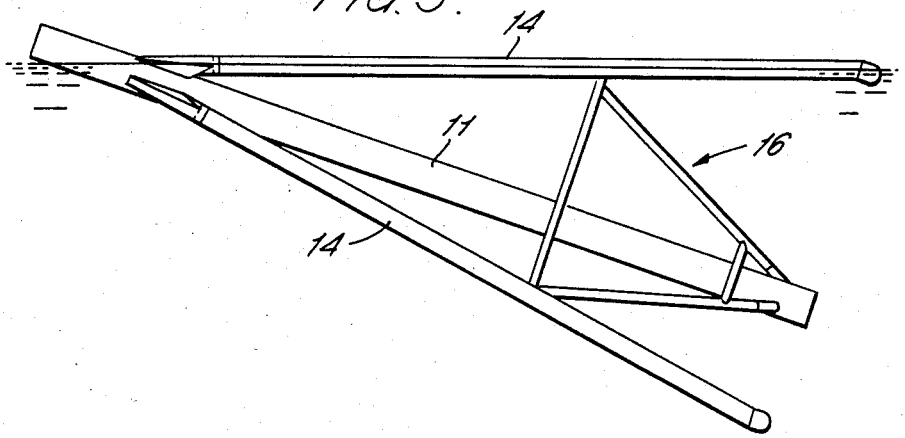

The column and leg assembly shown in FIG. 5 is then towed to the desired location where the foundations 12, 15 have already been installed. The column and leg assembly is upended by partially flooding the column and the legs and then the column and leg assembly is lowered to the seabed by further flooding of the column and legs. The column and legs slide into the foundations and the legs 14 are grouted to the leg foundations 15. The deck 23 is then installed and the central column 11 is grouted to its foundation 12.

Figure 6A:
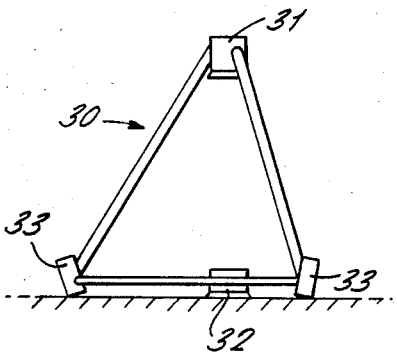
Figure 6A:
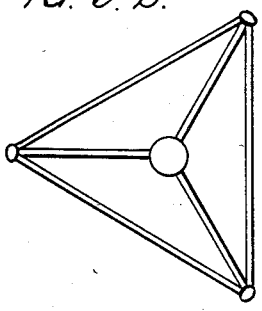

A modification of the first embodiment of an offshore tower structure and method of construction thereof will now be described with reference to FIGS. 6 and 7. FIGS. 6*a* and 6*b* show a modified bracing unit generally indicated at 30 of the same general configuration as the bracing unit 16 already described. However, the bracing unit 30 has five sleeves; two sleeves 31 and 32 for engagement by the column 11 and 3 sleeves 33 for engagement by the legs 14. It will be appreciated that the column 11 and legs 14 are no longer provided with spuds in this modified embodiment. The sequence of operations to construct the column and leg assembly is similar to the sequence described with reference to FIGS. 1 to 5. The bracing unit 30 is held vertical with cranes, while the central column 11 is floated into the sleeves 31 and 32 of the bracing unit and the bracing unit is then grouted to the column. A first leg 14 is then floated into an associated sleeve 33 of the bracing unit 30 and then into an associated sleeve 21 extending from the column 11. The leg is welded to the central column 11 and grouted to the bracing unit 30, said attachments being carved out at water level as before. As before, the structure is then rotated about the longitudinal axis of the central column 11 and held in a stable position, for example by a barge. The second leg is then floated into position and attached in same way as the first leg at water level.

Figure 7:
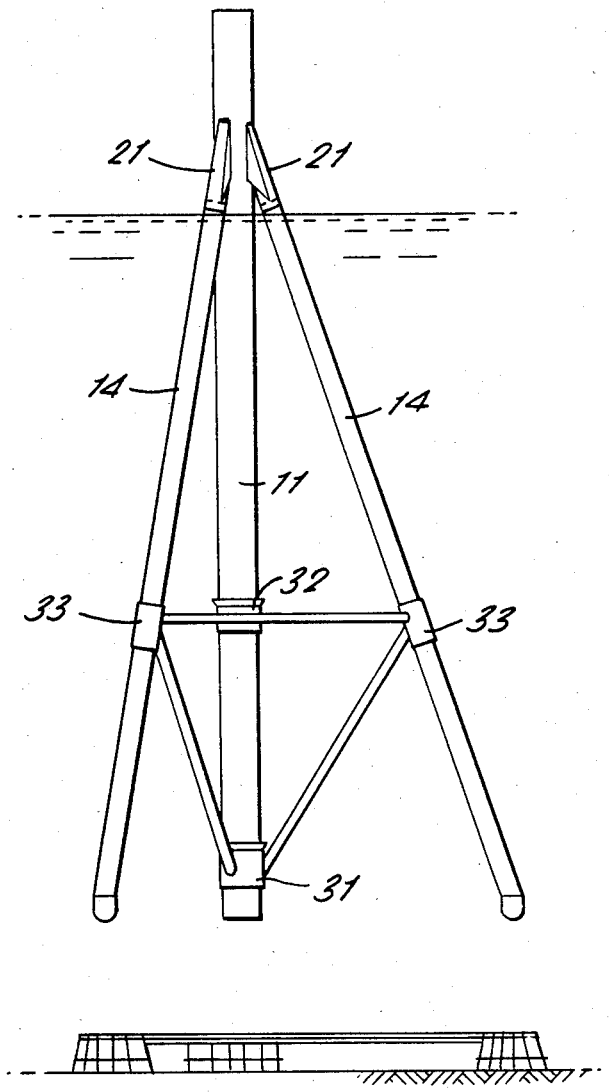

The sequence is repeated to secure the third leg in place and this provides a structure as shown in FIG. 7. The column and leg assembly of FIG. 7 is then floated to a desired location where a foundation has been installed and the column and leg assembly is lowered onto the foundation by flooding of the column and legs. The legs are grouted to the foundation, the platform is installed on the column and then the column is grouted to the foundation.

The embodiments described have the advantages that assembly is carried out inshore in sheltered water, that connections between all members can be made at water level, that a horizontal field weld of legs to the column is possible, that no temporary foundations are required, that relatively little pumping and flooding is necessary, that the deck structure may be attached before towing out of the completed structure and that the bracing unit requires only a modest weight of steel.

The standard material used in construction of the embodiments described is steel, although it will be appreciated that there may be cases where suitable materials other than steel may be used.

We claim:

1. A method of assembling an offshore tower structure having a foundation unit for anchoring in position on the seabed, a central column for securing at its lower end to the foundation unit to extend upwardly therefrom to above the water level in use and support a service platform at its upper end and carry services such as conductors and risers between the seabed and the platform, at least three support legs to be fixed at their upper ends to the column towards the upper end thereof and secured at their lower ends to the foundation unit at points spaced from the lower end of the column to provide support for the column, and a preformed bracing unit to be rigidly connected with the column and legs and between legs, which method comprises:

floating the column on the surface of the water;

securing the bracing unit to the column;

floating each of the legs in turn into position and attaching them to the assembled column and bracing unit one by one, the column being rotated about its longitudinal axis after each leg is attached in readiness for the attachment of the next leg;

anchoring the foundation unit on the seabed; and lowering the assembled support legs, bracing unit and column onto the foundation unit.

2. A method as set forth in claim 1 wherein the bracing unit, column and leg connections are made by welding.

3. A method as set forth in claim 1 wherein the support legs and column are lowered by flooding.

4. A method as set forth in claim 1 wherein sleeve attachments are provided between the intermediate portion of the legs and the bracing and between the bracing and the column; the upper ends of the legs are welded to the column and the lower ends of the legs are grouted to the foundation unit; and the sleeve connections are grouted.

* * * * *